US009694397B2

(12) United States Patent
Boukari

(10) Patent No.: US 9,694,397 B2
(45) Date of Patent: Jul. 4, 2017

(54) METHOD FOR THE DYNAMIC CLEANING OF WATER LINES IN A VEHICLE AND DEVICE FOR THE IMPLEMENTATION THEREOF

(75) Inventor: Morou Boukari, Toulouse (FR)

(73) Assignee: PRODOSE, Bessieres (FR)

( * ) Notice: Subject to any disclaimer, the term of this patent is extended or adjusted under 35 U.S.C. 154(b) by 574 days.

(21) Appl. No.: 14/123,767

(22) PCT Filed: Jun. 5, 2012

(86) PCT No.: PCT/FR2012/051253

§ 371 (c)(1),
(2), (4) Date: Apr. 28, 2014

(87) PCT Pub. No.: WO2012/168645

PCT Pub. Date: Dec. 13, 2012

(65) Prior Publication Data

US 2014/0230845 A1 Aug. 21, 2014

(30) Foreign Application Priority Data

Jun. 6, 2011 (FR) ..... 11 54902

(51) Int. Cl.
*B08B 9/032* (2006.01)
*B08B 3/12* (2006.01)

(52) U.S. Cl.
CPC ..... *B08B 9/0321* (2013.01); *B08B 3/12* (2013.01); *B08B 9/032* (2013.01)

(58) Field of Classification Search
CPC ..... B08B 9/032; B08B 9/0321; B08B 9/0326; B08B 9/0328; B08B 3/12
USPC ... 134/1, 22.11, 22.12, 22.18, 169 C, 168 C, 134/167 C
See application file for complete search history.

(56) References Cited

U.S. PATENT DOCUMENTS

| | | | | |
|---|---|---|---|---|
| 5,127,961 | A | 7/1992 | Aiton | |
| 5,530,988 | A * | 7/1996 | McQuillan | F02B 77/04 15/406 |
| 7,421,757 | B1 * | 9/2008 | Garcia, Jr. | B08B 9/032 134/1 |
| 2003/0051746 | A1 * | 3/2003 | Park | B08B 9/0325 134/169 C |
| 2004/0118437 | A1 * | 6/2004 | Nguyen | A61B 1/123 134/22.11 |
| 2008/0115809 | A1 * | 5/2008 | Persson | B08B 5/02 134/22.18 |

(Continued)

FOREIGN PATENT DOCUMENTS

| | | | |
|---|---|---|---|
| DE | 10 2009 009938 | A1 | 8/2010 |
| WO | WO 9221453 | A1 | 12/1992 |

OTHER PUBLICATIONS

International Search Report, Sep. 18, 2012, from International Phase of the instant application.

*Primary Examiner* — Saeed T Chaudhry
(74) *Attorney, Agent, or Firm* — Paul & Paul

(57) ABSTRACT

The invention relates to a method for the dynamic cleaning of supply ducts for drinking water in a vehicle (A), said method being noteworthy in that it consists in creating a shockwave (0) in the duct (210) to be cleaned. The invention also relates to a device for implementing said method. Applications: cleaning of water supply ducts in vehicles including aircraft.

7 Claims, 4 Drawing Sheets

(56) References Cited

U.S. PATENT DOCUMENTS

2009/0020142 A1* 1/2009 Miyako ..... A61B 1/123
134/22.14

* cited by examiner

METHOD FOR THE DYNAMIC CLEANING OF WATER LINES IN A VEHICLE AND DEVICE FOR THE IMPLEMENTATION THEREOF

FIELD OF THE INVENTION

This invention relates to the field of maintaining lines forming the water network of vehicles and in particular to the adaptations making it possible to carry out the cleaning of said lines in the best conditions.

DESCRIPTION OF PRIOR ART

Conventionally, the drinking water distributed in a vehicle such as an aircraft, a train car, a boat etc. is treated according to different solutions:

- chemical means (chlorine and derivatives, active oxygen, etc.),
- means of filtration (for example a carbon filtration cartridge, ion exchange, etc.),
- etc.

Nevertheless, due in particular to the non-continuous use of the distribution lines, over time these various means do not prevent the depositing of impurities, biofilms and/or the appearance of bacteria on the inner walls of the lines.

In prior art there are so-called "dynamic" methods for cleaning lines that avoid or which supplement said treatment solutions.

Among these methods, the document DE 102009009938 describes a method comprising inserting gas into the water flowing in the supply ducts for water of an aircraft in order to create turbulence in the circulating flow, turbulence that is able to avoid the depositing of biofilms and/or to dislodge said deposit for the purposes of removal. The turbulence created by such a method is nevertheless not always sufficient to carry out a complete cleaning.

There is also the method known as air scouring, such as that described in the document U.S. Pat. No. 5,915,395 consisting originally in isolating a section of the supply duct and in removing the water from the duct by using compressed clean air. Air and water are gradually reintroduced into the duct. The swirling action of the compressed air and of the water removes the deposits of tartar, sediment, materials and debris from the duct. The acceleration and the swirling of the water and of the compressed air is in particular implemented by the opening of an end of the isolated section of the duct after injection of compressed air. This document describes more specifically the fact that the air introduced into the duct can contain means of treatment that avoid or that slow down any future deposit.

Despite the good results obtained, such a solution that uses, as in the previous solution, an intermediate state of the fluid flowing in the duct, i.e. a fluid formed from water and gas creating turbulence in the duct to be cleaned, may not be sufficient to dislodge certain deposits.

DESCRIPTION OF THE INVENTION

Taking the view in this regard, the applicant has conducted research aimed at designing a method and a device for cleaning supply ducts for drinking water for vehicles making it possible to optimize the results obtained by the solution of prior art.

This research has resulted in the designing of a method for the dynamic cleaning of supply ducts for drinking water of a vehicle comprising creating a shockwave in the duct to be cleaned.

According to the invention, the creation of this shockwave is advantageously implemented by the method of the invention which comprises:

- partially filling a volume with a liquid,
- filling with gas under pressure, the volume that is not occupied by the liquid,
- releasing the liquid through a bottleneck communicating with said duct or ducts to be cleaned while still maintaining the pressure in such a way as to:
- create an accelerated displacement of the liquid in a first step and of the mixture of gas and of liquid that is created in a second step then,
- generate a shockwave, once the volume is emptied, shockwave that propagates downstream of said bottleneck through the mixture.

This characteristic is particularly advantageous in that the shock created defines a constraint on the deposits of biofilms, bacteria, tartar to which they cannot resist thus providing for their dislodging and their removal.

In order to isolate the duct wherein the shockwave is to propagate, it is sufficient to close all of the stop valves except for the stop valve located at the end of the duct involved.

This shockwave is carried out by the setting up of a brutal discontinuity in the nature of the fluid passing through the duct.

According to another particularly advantageous characteristic of the invention, the method comprises creating a fluid by mixing a liquid with gas under pressure and in propagating said shockwave in said fluid. Creating this mixture will make it possible not only to support the shockwave but also to create a turbulent phase that is conducive to the removal of any impurity in the duct. The method of the invention makes it possible as such to associate the advantages of an intermediary gas and liquid phase with those of a shockwave optimizing the constraints that the deposits to be removed are subjected to and to guarantee their dislodging for the purposes of removal.

The method of the invention therefore makes it possible to associate the creation of a shockwave with an intermediate gas/liquid phase able to create turbulence in the duct to be cleaned.

The acceleration is obtained by pressurizing the unoccupied volume and maintaining the pressure despite the escaping of the liquid by the bottleneck. The gas and liquid mixture is obtained when the volume is almost emptied and when the liquid at its highest acceleration (due to the pressure being maintained) carries gas in its displacement and the shockwave is generated due to the sudden absence of liquid to be displaced due to the complete and accelerated emptying of the volume.

According to another particularly advantageous characteristic, the method comprises heating the water filling the volume thus participating in the cleaning.

According to another particularly advantageous characteristic, the vehicle is an aircraft.

The invention also relates to the device making it possible to implement the method described hereinabove. As such, according to a characteristic of this device, said bottleneck is created by the difference in diameter between the volume and the duct wherein the shockwave is propagated.

According to a particularly advantageous characteristic of the invention, said volume is that of a water tank of the vehicle.

According to another particularly advantageous characteristic of the invention, said volume is that of an independent tank that connects from the exterior to the duct network of the vehicle.

This tank can be associated with the inside of the same module to various functional subassemblies that participate in the cleaning method. As such, according to a particularly advantageous characteristic, said independent tank is included in a mobile cleaning module that brings together over the same platform, the following subassemblies:

- water tank that will constitute the volume partially filled here with water,
- means for heating the water contained in the tank which will then become a cleaning liquid,
- means for pressurizing associated to the tank in order to pressurize the latter and in order to maintain this pressure,
- thermometer allowing the temperature of the water to be controlled,
- metering pump, and
- a means for filtering water.

This single module can as such, by connecting to the network of lines, implement the method of the invention. It further makes it possible to implement another characteristic of the method of the invention which comprises heating the water filling the volume of the tank in such a way that the water provides, via its temperature, a treatment function.

According to another characteristic, said liquid is water and in particular water already present in the storage tank of the vehicle.

According to another characteristic, implementing the method of the invention comprises controlling the filling and the emptying of a tank of the vehicle as well as pressurizing it in order to carry out the various steps required to obtain an intermediary fluid phase and the propagation of the shockwave through said fluid.

As the fundamental concepts of the invention have just been exposed hereinabove in their most elementary form, other details and characteristics shall appear more clearly when reading the following description and in reference to the annexed drawings, given by way of a non-restricted example, several embodiments of a method and of a device according to the invention.

DESCRIPTION OF PREFERRED EMBODIMENTS

Figure 1:
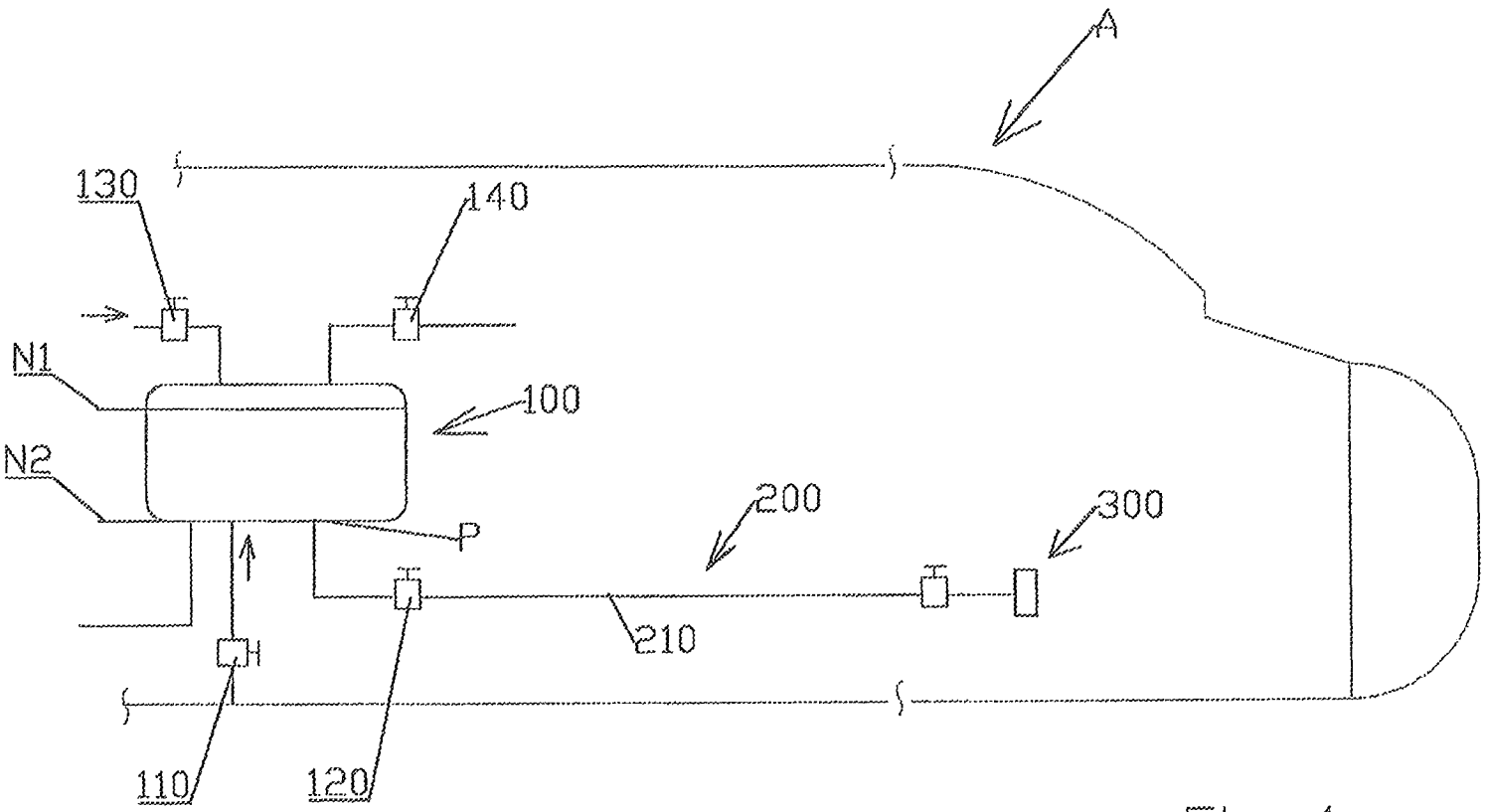
FIG. 1 is a diagrammatical drawing of a supply circuit for drinking water of an aircraft whereon is applied the method of the invention using a tank integrated into said aircraft.
Figure 2:
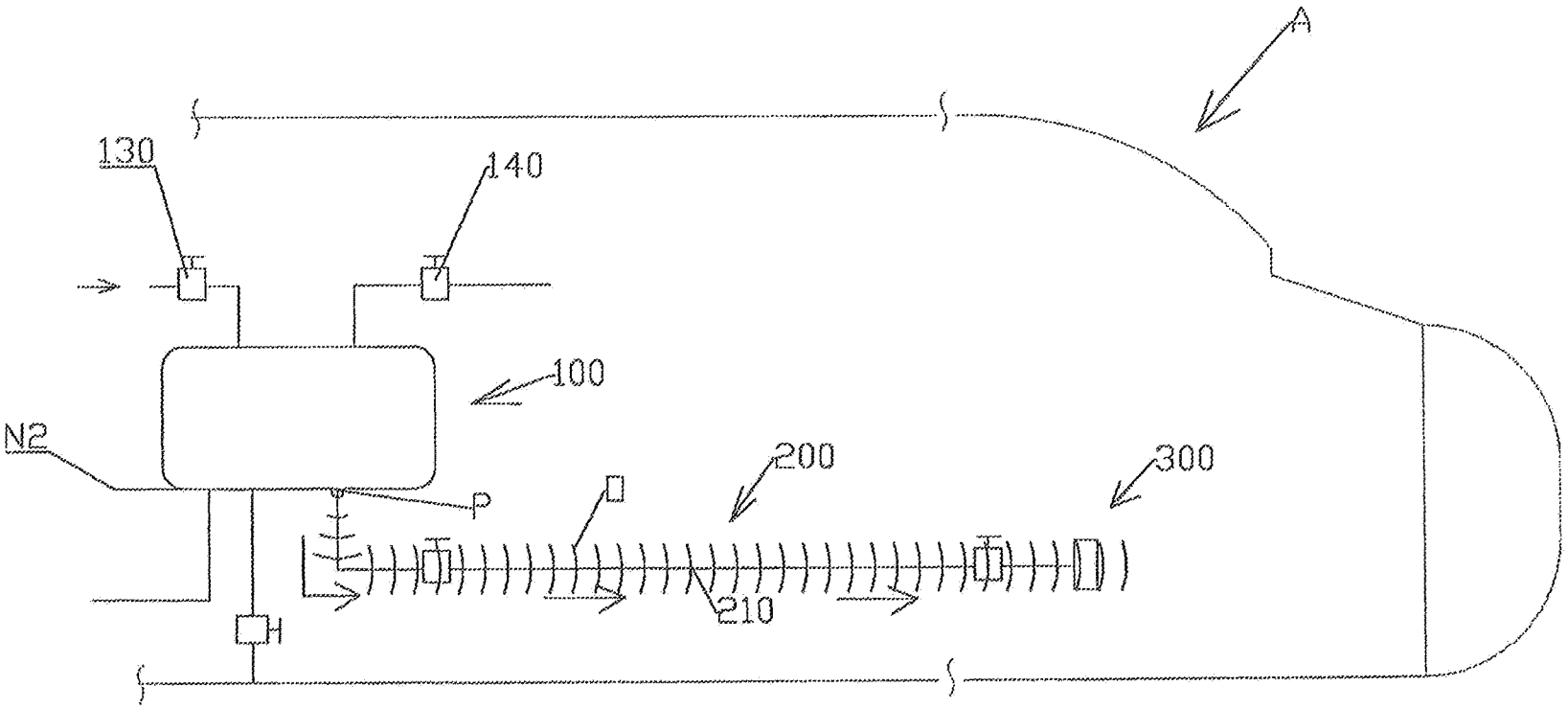
FIG. 2 shows the diffusion of the shockwave in the circuit of FIG. 1.

Such as shown in the drawings of FIGS. 1 and 2, the method of the invention applies to the supply network of drinking water of an aircraft referenced as A which as a whole comprises a water tank 100 as well as a plurality of lines 200 forming said supply network of water making it possible to distribute the water to the stop valves available for the users such as the stop valve 300 shown.

The method of the invention for the elimination of deposits is applied to the portion of a duct 210 that puts said tank 100 in communication with said stop valve 300.

In order to implement the principles of the invention, the tank 100 has a diameter that is largely greater than that of the duct 210 to be cleaned.

This difference in diameter creates a bottleneck at the junction point P between said duct 210 and said tank 100.

The tank 100 further comprises in its original version or for the purposes of implementing the method of the invention:

- an inlet valve 110 for the water communicating with the exterior of the aircraft A,
- at least one valve controlling the output 120 of water from the tank 100,
- an inlet valve for gas 130 making it possible to pressurize the contents of the tank 100,
- an outlet valve for the gas 140 making it possible to adjust said pressure.

The following operations are then implemented:

- the stop valve 300 is closed as well as the valves 120 and 130,
- the valve 140 is open and the water and/or a disinfecting liquid is injected from the exterior into the tank 100 by the valve 110,
- when the liquid reaches the high level N1 in the tank 100, the supply of water is stopped and the corresponding valve 110 is closed,
- the valve 140 is closed and the valve 120 that gives access to the duct 210 is opened.
- gas is injected into the tank by the valve 130,
- when the pressure reaches the desired value inside the tank 100, the stop valve 300 is opened in order to start the displacement of the liquid inside the duct 210.

These operations provide the following physical effects:

- as the liquid is displaced in the duct 210, its level drops in the tank 100,
- once the liquid reaches the low level N2, i.e. once it reaches the level of the bottleneck P, a sudden discontinuity in mass, velocity and pressure is then generated,
- a supersonic speed is reached at the level of point P,
- a shockwave O of high intensity accompanied by substantial turbulence is then generated downstream of the point P and is propagated inside the duct 210 to be cleaned.

According to a measured test, the velocity at the point P changes from less than 10 meters per second to a speed exceeding 440 meters per second which is the velocity of the gas at the point P when the discontinuity is generated.

Three zones of propagation are created in the duct 210:

- a first zone of contact between the gas and the liquid,
- a second zone located upstream of the first wherein only the liquid is present and wherein the shockwave is propagated,
- a third zone downstream of said zone of contact where only the gas is present and inside of which the rarefaction or volume expansion wave is propagated.

Figure 3:
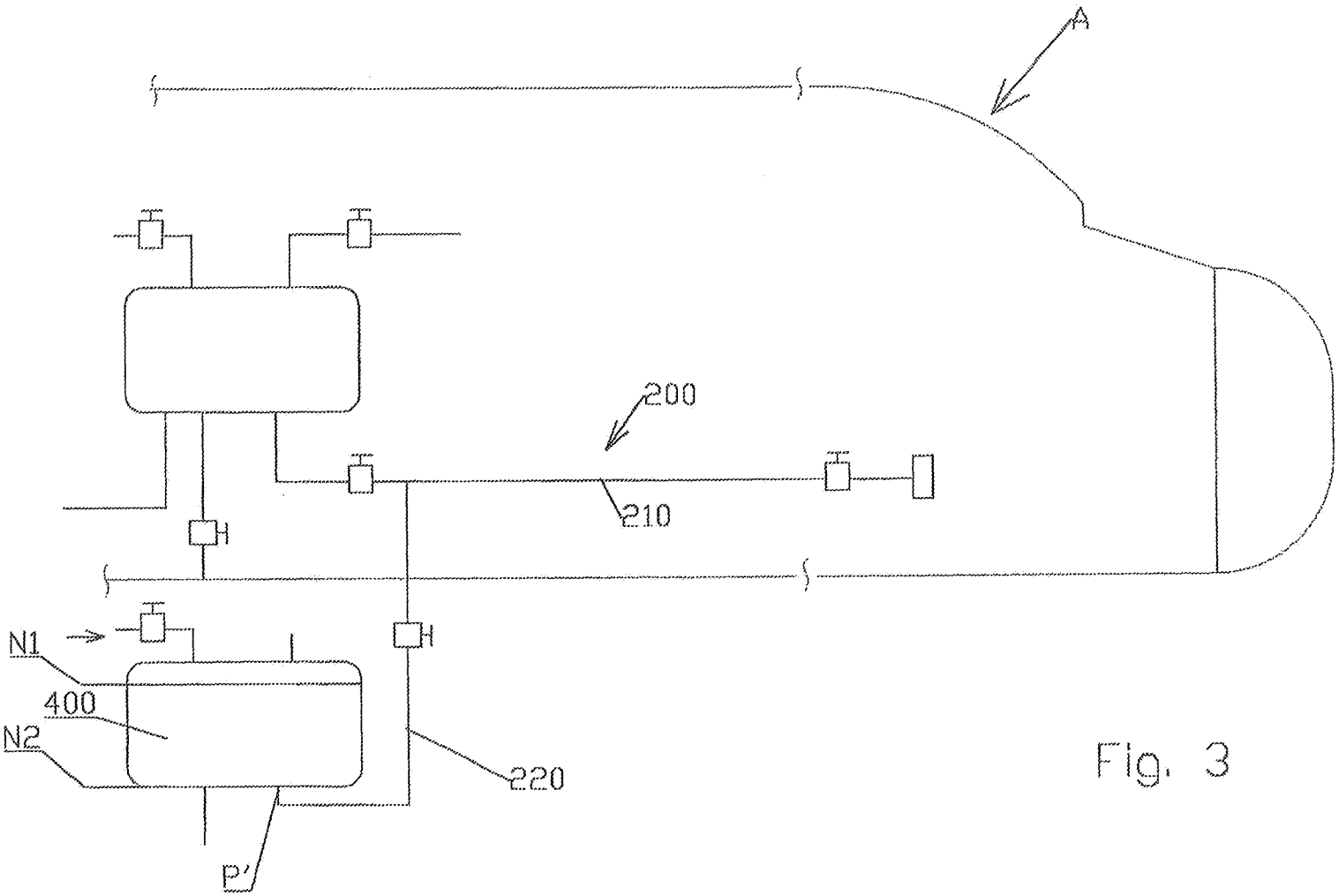
FIG. 3 is a diagrammatical drawing of a circuit for the supply of drinking water of an aircraft whereon is applied the method of the invention using an independent tank of the aircraft.
Figure 4:
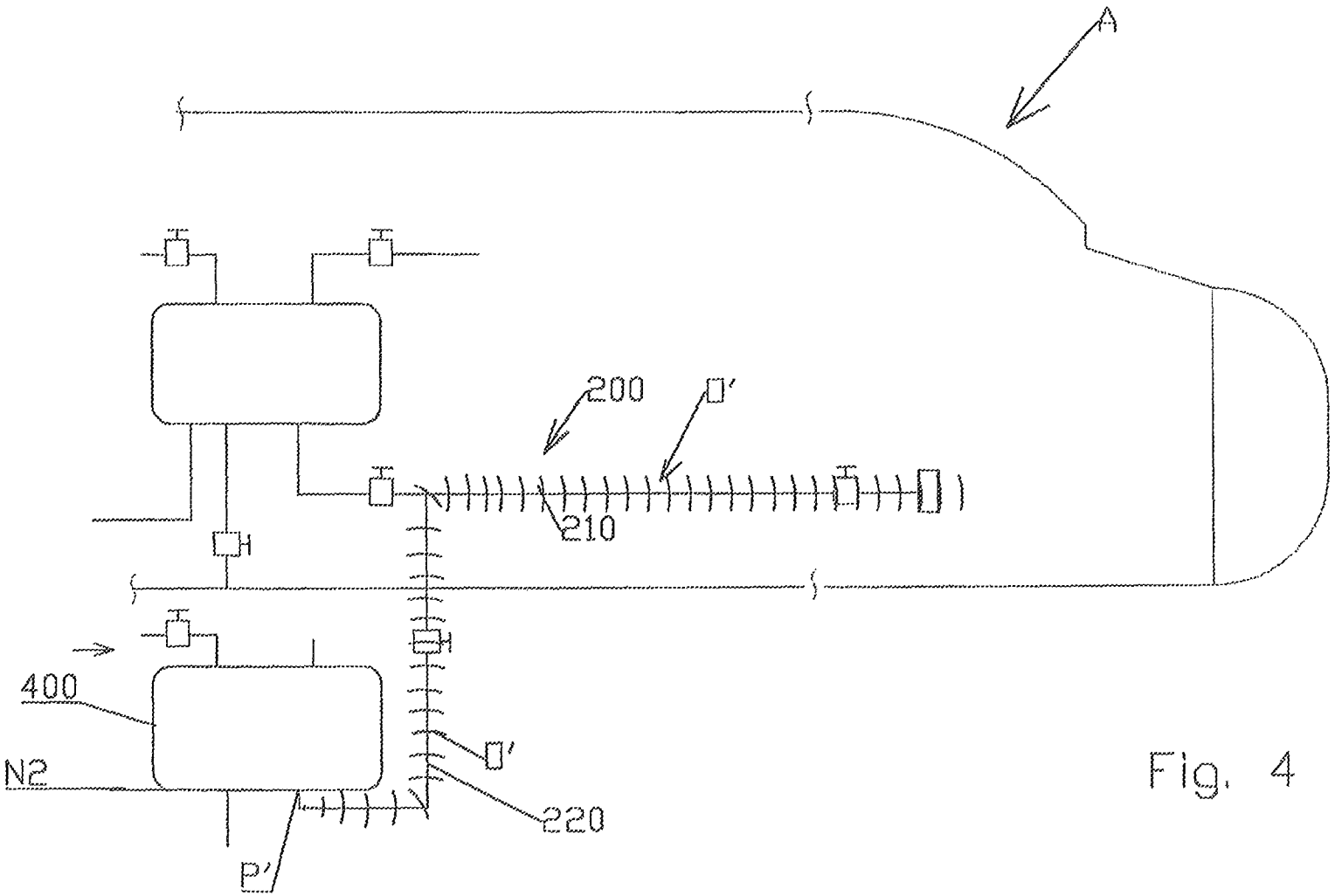
FIG. 4 shows the diffusion of the shockwave in the circuit of FIG. 3.

The drawings in FIGS. 3 and 4 show the implementation of the same method by a device that is slightly different in that it is comprised of a tank 400 independent of the aircraft A that connects to the network of lines 200 and associated to functional subassemblies making it possible to provide for the various phases of the method. As with the device described hereinabove, the latter is based on a large difference in diameter between that of the tank 400 and that of the duct 220 for connecting with the duct 210 to be cleaned. As such, a bottleneck at the point P' for linking between the duct 220 and the tank 400 makes it possible to create the desired discontinuity.

As shown in the drawing in FIG. 4 and in accordance with the method of the invention, the arrival of the liquid at the bottom of the tank 400 creates the discontinuity that creates the sought shockwave O' propagating through the duct 220 then 210 in the gas, the air/liquid mixture and in the liquid.

It is understood that the method and the device, which have just been described and shown hereinabove, were described and shown for the purposes of divulgation rather than as a limitation. Of course, various arrangements, modifications and improvements can be made to the examples hereinabove, without however leaving the scope of the invention.

The invention claimed is:

1. In a vehicle (A) having supply ducts for drinking water, a method for dynamic cleaning of a supply duct for drinking water of the vehicle (A), comprising creating a shockwave (0) in the duct to be cleaned, the supply duct having a first end and a second end;

the method comprising:

(a) partially filling a volume with a liquid, (b) filling the volume that is not occupied by the liquid with gas under pressure, (c) releasing the liquid through a bottleneck communicating with the first end of said duct to be cleaned the second end of said duct being open while maintaining the pressure, the liquid being displaced through the bottleneck by the gas under pressure in order to empty the volume of liquid, in such a way as:

to create an accelerated displacement of the liquid from the volume to the supply duct in a first step, create a mixture of gas and liquid in a second step, and create an accelerated displacement of the mixture of gas and of liquid that is created in a second step, and to generate a shockwave (0) once the volume is emptied of the liquid, the shockwave propagating through the mixture.

2. Method according to claim 1, further comprising creating a fluid by mixing a liquid with gas under pressure and in propagating said shockwave in said fluid.

3. Method according to claim 1, further comprising heating the liquid that fills the volume.

4. Method according to claim 1, wherein the vehicle (A) is an aircraft.

5. Method according to claim 1, wherein said bottleneck is created by a difference in diameter between the volume and the supply duct.

6. Method according to claim 1, wherein said volume is a water tank of the vehicle (A).

7. Method according to claim 1, wherein said vehicle (A) has a network of ducts, and said volume is an independent tank, the independent tank being connected to the network of ducts of the vehicle (A).

* * * * *